United States Patent [19]

Rossi

[11] Patent Number: 4,641,445

[45] Date of Patent: Feb. 10, 1987

[54] NOVELTY DISPLAY DEVICE

[76] Inventor: Frank R. Rossi, 8830 Trinity, Detroit, Mich. 48228

[21] Appl. No.: 768,067

[22] Filed: Aug. 22, 1985

[51] Int. Cl.[4] ..... G09F 19/00

[52] U.S. Cl. ..... 40/410; 40/430; 272/15

[58] Field of Search ..... 40/410, 409, 430, 431, 40/435, 502; 272/15

[56] References Cited

U.S. PATENT DOCUMENTS

| | | | |
|---|---|---|---|
| 901,319 | 10/1908 | Bruen | 272/15 |
| 1,101,422 | 6/1914 | Fielding | 40/410 |
| 1,221,494 | 4/1917 | Wiley | 40/410 |
| 1,350,542 | 8/1920 | Booth | 272/15 |
| 1,846,858 | 2/1932 | Glaser et al. | 40/431 |
| 2,435,612 | 2/1948 | Snyder | 272/15 |
| 3,147,175 | 9/1964 | Gonzalez | 272/15 |
| 3,158,955 | 12/1964 | Sturgis | 272/15 |
| 3,248,815 | 5/1966 | Arage | 40/431 |
| 3,295,240 | 1/1967 | Garte | 40/502 |
| 3,905,140 | 9/1975 | Damiano | 40/409 |
| 3,999,750 | 12/1976 | Perkins | 40/410 |
| 4,215,500 | 8/1980 | Sharp | 40/409 |
| 4,240,218 | 12/1980 | Kotzin | 40/430 |
| 4,490,931 | 1/1985 | Fleemin | 40/409 |

FOREIGN PATENT DOCUMENTS

| | | | |
|---|---|---|---|
| 1083064 | 9/1967 | United Kingdom | 40/410 |

*Primary Examiner*—Gene Mancene
*Assistant Examiner*—Cary E. Stone
*Attorney, Agent, or Firm*—Gifford, Groh, VanOphem, Sheridan, Sprinkle & Dolgorukov

[57] ABSTRACT

A novelty display device which simulates a snow fall. The device includes a base having a transparent container positioned on its top which forms a substantially closed chamber. An electric motor is contained within the base and rotatably drives a fan blade contained within and adjacent bottom of the chamber. Lightweight particulate matter is disposed within the interior of the chamber so that, upon actuation of the fan blade, the fan blade inducts the particulate matter from the bottom of the chamber and circulates the particulate matter throughout the chamber thereby simulating a snowfall.

6 Claims, 5 Drawing Figures

Fig-1
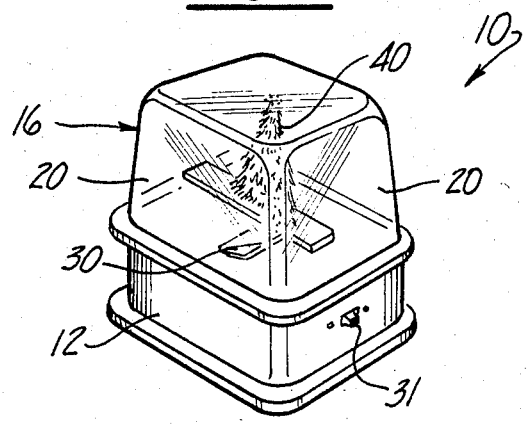
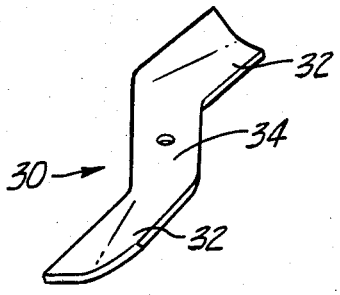
Fig-3
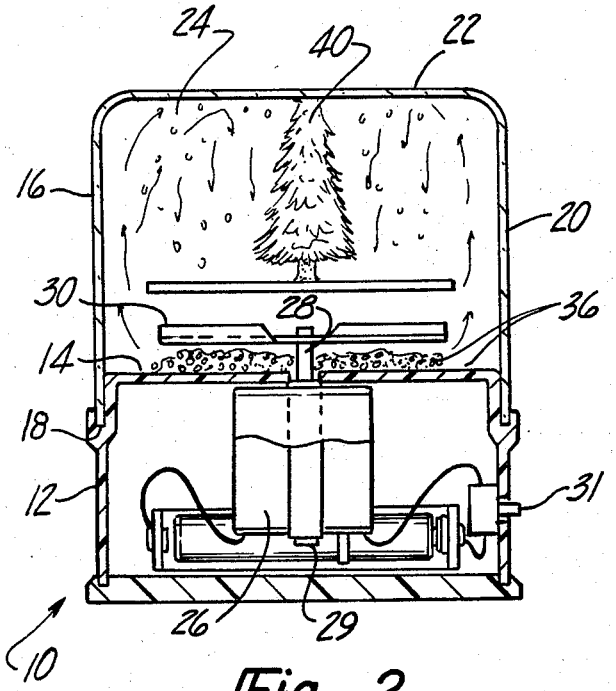
Fig-2
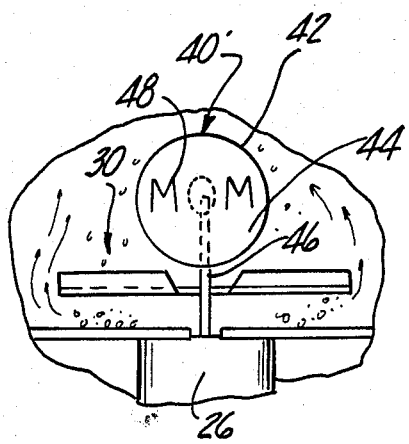
Fig-4
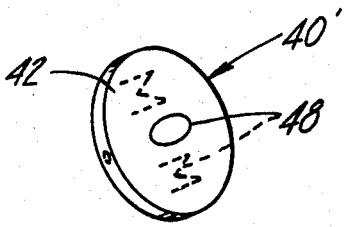
Fig-5

NOVELTY DISPLAY DEVICE

BACKGROUND OF THE INVENTION

I. Field of the Invention

The present invention relates generally to novelty display devices and, more particularly, to such a device designed to simuilate a snowfall.

II. Description of the Prior Art

There are a number of previously known display devices which are particularly designed to simulate a snowfall. Many of these previously known display devices, such as shown in U.S. Pat. Nos. 2,621,042 to Stein et al and U.S. Pat. No. 4,028,830 to Ottinger, utilize blowers or pumps to circulate particular matter in order to simulate a snowfall.

One disadvantage of these previously known devices, however, is that they are relatively complicated and complex in construction. This, in turn, increases not only the size of the display device but also its cost. For these reasons, such display devices have not enjoyed wide spread use or acceptance.

SUMMARY OF THE PRESENT INVENTION

The present invention provides a novelty display device which overcomes all of the above mentioned disadvantages of the previously known devices.

In brief, the display device of the present invention comprises a base having a top. A transparent container is positioned on the base top thus forming a substantially closed chamber above the base.

A fan blade is contained within the chamber adjacent its bottom while an electric motor is mounted within the base and rotatably drives the fan blade. Lightweight particulate matter is disposed within the chamber so that, upon rotation of the fan blade, the fan blade inducts the particulate matter from the top of the base and circulates the particulate matter throughout the chamber thereby simulating snowfall.

In a preferred embodiment of the invention, a display figure is also contained within the chamber and above the fan blade. Such display figures can comprise a skiier, a Christmas scene, or the like.

In an alternate embodiment of the invention, the display figure comprises a planar member having two sides and which is attached to the fan blade so that the display figure rotates in unison with the fan blade. Furthermore, letter indicia are provided on both sides of the planar member which, together, form a recognizable word during rotation of the display figure by the fan blade.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which:

FIG. 1 is an elevational view illustrating a preferred embodiment of the present invention;

FIG. 2 is a side cross-sectional view of the preferred embodiment of the invention;

FIG. 3 is a view illustrating one component of the preferred embodiment of the invention;

FIG. 4 is a view similar to FIG. 2 but illustrating a second preferred embodiment of the invention; and FIG. 5 is a view illustrating the reverse side of the display figure of FIG. 3.

DETAILED DESCRIPTION OF PREFERRED EMBODIMENTS OF THE PRESENT INVENTION

With reference first particularly to FIGS. 1 and 2, a preferred embodiment of the display device 10 of the present invention is thereshown and comprises a base 12 having a top 14. Although the base 12 is illustrated in FIG. 1 as generally rectangular in shape, it may be of any other shape without deviation from the spirit or scope of the invention.

Still referring to FIGS. 1 and 2, the display device 10 further comprises a container 16 which is constructed of a transparent material, such as plastic, glass or the like. The container 16 includes an open bottom 18, closed side 20 and a closed top 22. The container 16 is dimensioned so that its open bottom 18 fits on the top 14 of the base 12, and, in doing, so, forms a substantially closed chamber 24 above the base 12.

With reference now to FIG. 2, an electric motor 26 having an output shaft 28 is secured within the interior of the base 12 so that the output shaft 28 protrudes through the base top 14 and into the chamber 24. Any conventional means can be employed to secure the motor 26 within the interior of the base 12.

An electric battery 29 is contained within the interior of the base 12 and an electric switch 30 is mounted to the base 12 so that the switch 30 is accessible exteriorly of the base 12.

Conventional electrical connections are provided between the battery 29, switch 31 and electric motor 26 so that the switch 31 in one position electrically connects power to the motor 26 and vice versa. When electric power is connected to the motor 26, the motor 26 rotatably drives its output shaft 28.

With reference now particularly to FIGS. 2 and 3, a fan blade 30 is secured to a free end of the electric motor output shaft 28 so that the fan blade 30 is positioned within the chamber 24 adjacent to but spaced upwardly from the base top 14. Although any conventional fan blade 30 can be employed, the fan blade 30 preferably includes two elongated end segments 32 having axes which are spaced apart and generally parallel to each other. A transverse central segment 34 connects the inner ends of the segments 32 together and the motor shaft 28 is secured to a midpoint of the central segment 34.

Referring again to FIG. 2, lightweight particulate matter 36 is contained within the chamber 24 and, assuming the fan blade 30 is stationery, gravitates to the top 14 of the base 12. The particulate matter 36 can be constructed of any conventional material such as foam, styrofoam, paper or the like.

Upon activation of the electric motor 26, the electric motor 26 rotatably drives the fan blade 30. In doing so, the fan blade 30 inducts the particulate matter 36 from the base top 14 and continuously circulates the particulate matter 36 throughout the interior of the chamber 24. As the particulate matter 36 circulates through the chamber 24, the particulate matter 36 simulates a snowfall, falling leaves or the like (hereinafter collectively referred to as "snowfall").

As best shown in FIG. 2, in the preferred embodiment of the invention, a display figure 40 is preferably secured to the container 16 so that the display figure 40 is positioned within the chamber 24 and above the fan blade 30. The figure 40 can comprise, for example, a skier, Christmas scene, tree or the like. Furthermore, the display figure 40 can be rigidly secured to the container 16 or, alternatively, flexibly secured such as by a string or wire.

With reference now to FIGS. 4 and 5, a second preferred embodiment of the present invention is thereshown in which a display figure 40' comprises a planar member 42 having two sides 44 and 46. Letter indicia 48 is contained on both sides 44 and 46 of the planar member 42 so that the letter indicia 48 on one side 44 together with the letter indicia 48 on the other side 46 forms a recognizable word.

Unlike the embodiment of FIG. 1, the display figure 40' is secured to the motor shaft 28 so that the display figure 40' rotates in unison with the fan blade 30. Thus, upon actuation of the electric motor 26, the display figure 40' rotates and alternately displays both of its sides 44 and 46 so that the letter indicia 48 is readable as a recognizable word.

From the foregoing, it can be seen that the display device of the present invention provides a simple, inexpensive and yet totally effective display device for simulating snowfall.

Having described my invention, however, many modifications thereto will become apparent to those skilled in the art to which it pertains without deviation from the spirit of the invention as defined by the scope of the appended claims.

I claim:

1. A display device comprising:

a base having a top, a container positioned on said base top, said container being constructed of a transparent material and forming a substantially closed and air containing chamber, a fan blade contained within said chamber adjacent the bottom of said chamber, means for rotatably driving said fan blade, and light weight particulate matter contained within said chamber so that, upon rotation of said fan blade, said fan blade circulates said particulate matter through said air within said chamber thereby simulating a snowfall, a display figure secured to said rotatable driving means, wherein said display figure has two sides and comprising letter indicia on both sides of said display figure, said letter indicia being such that the letter indicia on both sides of said display figure together form at least one recognizable word while the letter indicia on a single side of said display figure does not form a recognizable word wherein said rotatable driving means alternately displays said sides of said display figure at a sufficiently high speed to form a recognizable word.

2. The invention as defined in claim 1 wherein said driving means comprises an electric motor contained in said base.

3. The invention as defined in claim 2 and comprising a battery contained in said base and switch means in said base for electrically connecting said battery to said motor.

4. The invention as defined in claim 1 wherein said particulate matter is constructed of a foam.

5. The invention as defined in claim 4 wherein said foam is styrofoam.

6. The invention as defined in claim 1 wherein said fan blade comprises two elongated end segments said end segments having axes which are spaced apart and generally aprallel to each other, and a central segment extending transversely between two ends of said end segments.

* * * * *